United States Patent [19]

Kii

[11] 4,259,555

[45] Mar. 31, 1981

[54] SELF-EXTINGUISHING GAS CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 889,518

[22] Filed: Mar. 23, 1978

[30] Foreign Application Priority Data

| | | | |
|---|---|---|---|
| Mar. 24, 1977 | [JP] | Japan | 52-32898 |
| Mar. 24, 1977 | [JP] | Japan | 52-32908 |
| Mar. 24, 1977 | [JP] | Japan | 52-32910 |
| Mar. 24, 1977 | [JP] | Japan | 52-32913 |

[51] Int. Cl.[3] ..... H01H 33/74

[52] U.S. Cl. ..... 200/148 R; 200/148 B; 200/150 D

[58] Field of Search ..... 200/148 R, 148 A, 148 B, 200/148 C, 148 D, 148 E, 148 F, 148 G, 148 H, 148 J, 148 BV, 144 R, 144 B, 150 D

[56] References Cited

U.S. PATENT DOCUMENTS

| | | | |
|---|---|---|---|
| 4,032,736 | 6/1977 | Ruffieux et al. | 200/148 B |
| 4,046,979 | 9/1977 | Hertz et al. | 200/148 A |
| 4,139,752 | 2/1979 | Itai et al. | 200/148 A |

FOREIGN PATENT DOCUMENTS

| | | | |
|---|---|---|---|
| 4729345 | 12/1972 | Japan | 200/148 B |
| 4942465 | 4/1974 | Japan | 200/148 B |

*Primary Examiner*—Gene Z. Rubinson
*Assistant Examiner*—Morris Ginsburg
*Attorney, Agent, or Firm*—Robert E. Burns; Emmanuel J. Lobato; Bruce L. Adams

[57] ABSTRACT

A circuit interrupter comprising a first pressure chamber for quickly increasing the pressure of an arc extinguishing gas therein by utilizing the energy of an electric arc established between a pair of separable contacts, and a second pressure chamber disposed around the first pressure chamber for releasing the arc extinguishing gas together with the high pressure gas upon the decrease of the arc current. The arc is extinguished by high pressure arc extinguishing gas released from the second pressure chamber. The first and the second pressure chambers are connected by a communication port having a check valve therein to increase the pressure of the arc extinguishing gas within the second pressure chamber.

9 Claims, 2 Drawing Figures

SELF-EXTINGUISHING GAS CIRCUIT INTERRUPTER

BACKGROUND OF THE INVENTION

1. Field of the Invention

This invention relates to a circuit interrupter and more particularly to a self-extinguishing gas circuit interrupter utilizing the arc energy dissipating from the electric arc established between the separated contacts to highly pressurize the surrounding $SF_6$ gas which is released toward the arc to extinguish it upon the decrease of the arc current.

2. Description of the Prior Art

In a circuit interrupter for interrupting a high voltage, it has recently been proposed to utilize a technique for effecting arc extinction by utilizing an arc extinguishing fluid such as $SF_6$ gas. Circuit interrupters utilizing this technique include the servo-extinguishing type gas circuit interrupter in which a high pressure arc extinguishing gas is puffed to the arc from a pressure chamber formed by a cylinder and a piston operatively connected to one of a pair of separable contacts, and the self-extinguishing type gas circuit interrupter in which a high pressure arc extinguishing gas is blasted by utilizing the pressure-rising phenomenon due to the arc energy dissipated to the surrounding arc extinguishing gas.

A typical self-extinguishing gas circuit interrupter utilizes the arc energy dissipated from the electric arc itself to highly pressurize the arc extinguishing gas within a defined space of a predetermined volume. When the arc inner pressure rapidly decreases due to the decrease of the arc current, this high pressure gas is released to extinguish the electric arc with its diffusing and cooling function due to the flow of the arc extinguishing gas. For such a self-extinguishing type gas circuit interrupter, the presence of pressure in the gas is indispensable both for the direct type and indirect type circuit interrupters. Also it is very effective for improving the arc extinguishing capability of the interrupter to expell the excessively ionized hot gas from the arcing region by utilizing the released high pressure gas. Further improvement in the arc extinguishing capability may be expected when this expulsion is effected within a short period of time. This is apparent from the fact that the interrupting capability and the interrupting capacity of the circuit interrupter are proportional to the pressure of the arc extinguishing gas in a gas puffer-type circuit interrupter.

With the conventional circuit interrupter, as the interrupting current increases, the pressure within the pressure chamber increases and the arc extinction capability is also proportionally improved. However, the structural strength of the pressure chamber must be made accordingly stronger. Since the typical pressure chamber is formed of an insulating material having an arc resistant property and insufficient in mechanical strength, the over all size of the pressure chamber must be large enough to obtain a pressure chamber having enough structural strength, resulting in one of the causes impeding realization of a small-sized, large capacity circuit interrupter.

With a larger pressure chamber, if the arc current is small and the pressure raising action is small, the arc extinguishing capability of the arc extinguishing gas is insufficient, and the temperature rise of the arc extinguishing gas degrades the arc diffusing capability of the gas due to the decrease in density and cooling capability.

SUMMARY OF THE INVENTION

An object of the present invention is to provide a circuit interrupter small in size and large in capacity.

Another object of the present invention is to provide a circuit interrupter of the self-extinguishing type capable of efficiently utilizing the arc energy in generating a high pressure arc extinguishing gas, thereby making the interrupter effective even with a small current.

Accordingly, the present invention resides in a circuit interrupter wherein two pressure chambers containing an arc extinguishing fluid therein are disposed to form a double walled structure, thereby increasing the pressure resistant strength of the wall of the inner pressure chamber so that the interrupter may be small-sized and have a large capacity. Also, the pressure chamber in which separable electrical contacts are disposed is made smaller in volume than the other pressure chamber, thereby enabling high pressure fluid to be obtained by efficiently utilizing a small arc energy at the initial stage of the contact opening operation, whereby the interrupter exhibits an improved interrupting performance even with respect to a small current. The two pressure chambers may be communicated with each other by a plurality of communication ports, using the pressure chamber in which the contacts are disposed as a pressure generating chamber, and the pressure generated in the pressure generating chamber is supplied to the other pressure chamber thereby increasing the pressure of the arc extinguishing fluid within the pressure chamber, to improve the performance of the circuit interrupter. The circuit interrupter may also include a check valve for communicating the first and the second pressure chambers disposed one in the other, with the separable contacts being disposed within the smaller second pressure chamber. The high pressure fluid generated in the second pressure chamber by the electric arc established between the separated contacts is introduced through the check valve into the first, outer, pressure chamber to utilize it for arc extinction, providing high arc extinction capability with a small simple structure. Adjustment of the check valve enables a sufficient pressure to be obtained even for small current interruption.

The present invention will become more readily apparent from the following description of the preferred embodiments taken in conjunction with the accompanying drawings, in which:

BRIEF DESCRIPTION OF THE DRAWINGS

In these Figures, the same reference numerals designate the identical or corresponding components of the illustrated embodiments.

DESCRIPTION OF THE PREFERRED EMBODIMENTS

Figure 1:
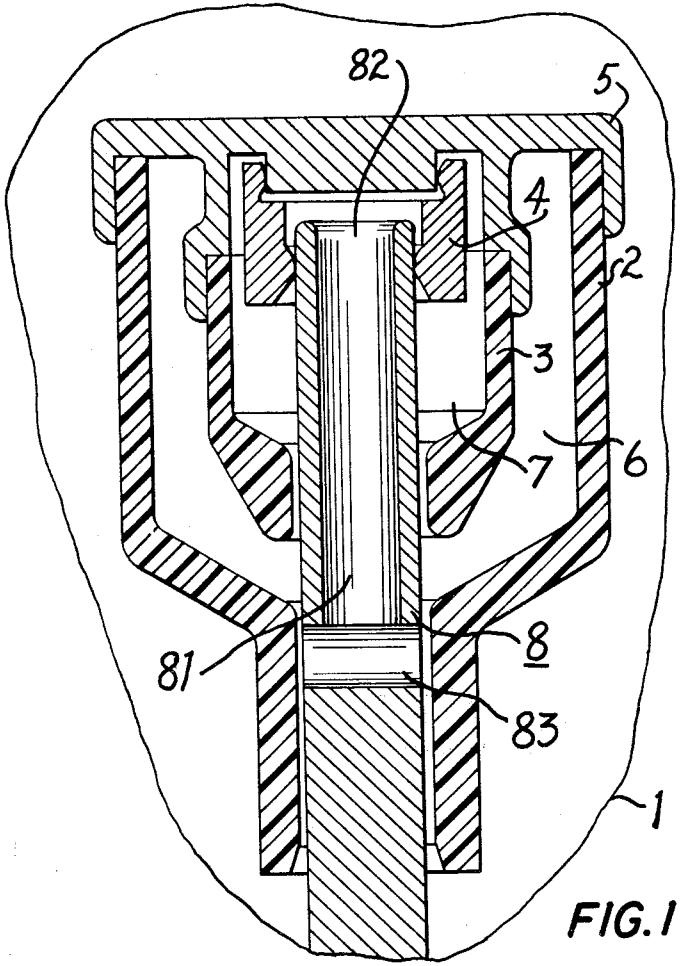
FIG. 1 is a sectional view of a self-extinguishing type gas circuit interrupter embodying the present invention.

Referring now to FIG. 1 of the drawing, a circuit interrupter of the present invention comprises a casing 1 within which an arc extinguishing gas such as sulfur hexafluoride ($SF_6$) gas is filled. Within the casing 1 is disposed a first closure member 2 formed of an electrically insulating, arc resistant material such as Teflon (Trade Mark). A second closure member 3 made of a similar material is substantially axially disposed within the first closure member 2. End portions of both the first and the second closure members 2 and 3 are thread engaged to an end cap 5 formed of an electrically conductive material and having secured thereto a stationary contact 4. An annulus defined between the first closure member 2, the second closure member 3, and the end cap 5 constitutes a first pressure chamber 6, which is also filled with the arc extinguishing gas such as $SF_6$ gas. A space defined between the second closure member 3 and the end cap 5 constitutes a second pressure chamber 7 which is also filled with $SF_6$ gas.

A stationary contact 4 is disposed within the second pressure chamber 7, and a movable contact 8 movably supported by any conventional operating mechanism extends through the first and the second closure members 2 and 3 into the second pressure chamber 7. The movable contact 8 has a hollow cylindrical portion 81 at one end. The hollow cylindrical portion 81 of the movable contact 8 has a nozzle 82 communicating with the second pressure chamber 7 at the end contacting the stationary contact 4 and a vent port 83 which is closed by a lower cylindrical wall of the first closure member 2 when in the contact closed position and open to the interior of the casing when in the contact open position to communicate the first and the second pressure chambers 6 and 7 to the interior of the casing 1. By selecting the volume of the inner space of the second pressure chamber 7 smaller than that of the first annular pressure chamber 6, the inner pressure required for arc extinction can be obtained even with a small arc current. The configuration of the second pressure chamber 7 may be selected to be an axially elongated thin annulus when the movable contact 8 is inserted therein, thereby to increase the contact area of the arc extinguishing gas with the established electric arc, enabling an efficient increase in the gas pressure.

When the movable contact 8 is moved downward by the tripping operation of the unillustrated well-known operating mechanism, the separable contacts 4 and 8 open to establish an electrical arc therebetween. Further downward movement of the movable contact 8 causes the arc to extend over the length of the second pressure chamber 7 while increasing the pressure within the second pressure chamber 7. Under these circumstances, during this operation of the circuit interrupter, the second pressure chamber 7 is kept substantially closed because the vent port 83 is kept closed by the lower cylindrical wall of the first closure member 2, allowing no pressure release therefrom, thereby providing the pressure required for arc extinction within a short period of time.

Still further downward movement of the movable contact 8 causes the vent opening 83 to move outside the lower cylindrical wall to open to the interior of the casing 1, and when the arc current reaches a zero value, the pressure within the second pressure chamber 7 is released through the nozzle 82 and the vent opening 83 of the movable contact 8 to immediately extinguish the arc. Since the high pressure in the second pressure chamber 7 is also released into the first pressure chamber 6, the high pressure gas is allowed to flow through a region of small flow resistance, whereby the high pressure gas in the first and the second pressure chambers 6 and 7 is rapidly released into the interior of the casing 1 through the nozzle portion 82, the hollow cylindrical portion 81 and the vent opening 83 of the movable contact 8, resulting in an effective arc extinction.

It is to be noted that, since the pressure exerted upon the wall of the second pressure chamber 7 is the pressure difference between the pressures in the first and the second pressure chambers 6 and 7, the second pressure chamber 7 can be designed to have an allowable pressure two times greater than that of the first pressure chamber 6 by just designing the second pressure chamber 7 to have the same pressure resistant strength. Thus, even with an insulating material having a relatively low strength, generation of the required high pressure for interruption is possible, resulting in an improvement in interrupting capability.

The inner volume of the second pressure chamber 7 may be made smaller than that of the first pressure chamber 6, thereby ensuring a quick pressure rise in the second pressure chamber 7 even with a small current.

Figure 2:
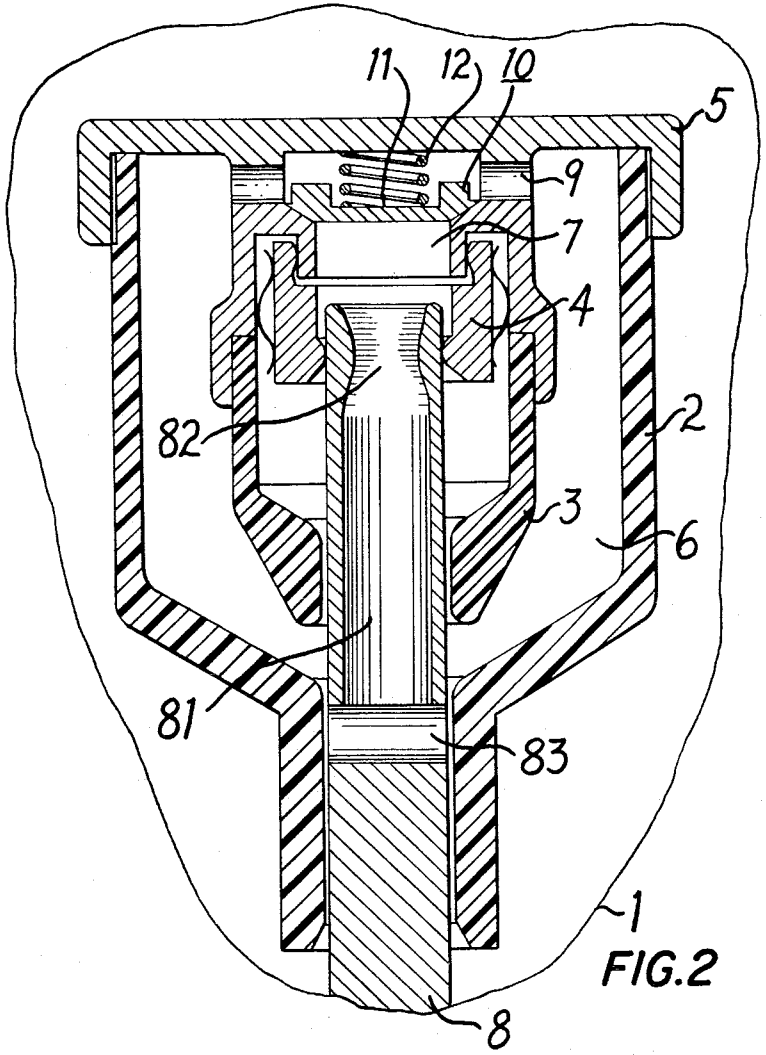
FIG. 2 is a sectional view of another self-extinguishing type gas circuit interrupter embodying the present invention.

FIG. 2 illustrates another embodiment of the present invention. The circuit interrupter shown in FIG. 2 is different from that shown in FIG. 1 only in that the former comprises a second pressure chamber 7 communicating with the first pressure chamber 6 through a plurality of communicating ports 9 formed in the cylindrical wall extending from the end cap 5. The communicating ports 9 are formed adjacent to the end cap 5 outside of the arcing region. Therefore, the arc extinguishing gas in the second pressure chamber 7 is allowed to flow through the communicating ports 9 into the first pressure chamber 6. Between the upper open portion of the second pressure chamber 7 and the communicating ports 9 in communication with the first pressure chamber 6 is disposed a check valve 10 comprising a valve 11 seated on a valve seat formed in a cylindrical extension supporting the stationary contact 4 for isolating the communicating ports 9 from the second pressure chamber 7, and a restoring spring 12 for biasing the valve 11 to its closed position. The check valve 10 is designed to open when the pressure within the second pressure chamber 7 is higher than the pressure within the first pressure chamber 6. By suitably selecting the spring factor of the compression spring 12, upon a small current interrupting operation, the second pressure chamber 7 can be kept closed when the pressure rise within the second pressure chamber 7 is slow to obtain an effective pressure rise in the second pressure chamber 7. It is to be noted that the check valve 10 is not always required for proper arc extinction according to the present invention, and may be omitted if desired.

When the movable contact 8 is moved downward by the operating mechanism (not shown) to separate from the stationary contact 4, an electric arc is established between the separated contacts 4 and 8. The electric arc heats and dissociates the arc extinguishing gas within the second pressure chamber 7 to generate a high pressure, which is then supplied through the communicating ports 9 to the upper portion of the first pressure chamber 6 directly from the second pressure chamber 7 or through the check valve 10 as the case may be, thereby effecting the pressure rise of the gas within the first pressure chamber 6 without raising the temperature. Further downward movement of the movable contact 8 causes the nozzle opening 82 formed in the contact 8 to be positioned at the opening of the first pressure chamber 6, and when the vent opening 83 formed in the movable contact 8 moves outside of the first closure member 2 to open to the interior of the casing 1, then the low temperature, high pressure arc extinguishing fluid stored within the first pressure chamber 6 is released through the nozzle opening 82 into the casing 1. Therefore, the electric arc is caused to immediately extinguish upon zero current by the effective cooling and diffusing function of the arc extinguishing fluid.

It is apparent from the foregoing description that by providing communicating ports 9 between the first pressure chamber 6 and the second pressure chamber 7, the pressure of arc extinguishing fluid within the first pressure chamber 6 can be raised without a temperature rise before it is released, thereby greatly improving the performance of the circuit interrupter. With the circuit interrupter having a check valve 10 at the communicating ports 9, since the gas in the first pressure chamber 6 is pressurized from the second pressure chamber 7 through the check valve 10, a unidirectional flow of low temperature, high pressure gas into the arcing region is ensured, thereby realizing excellent arc extinction performance with a small and simple circuit interrupter even for small current interruption.

In summary, the pressure chamber in which an arc extinguishing fluid is contained and in which a pair of separable contacts is disposed has a double-wall structure, thereby increasing the pressure resistant strength of the inner pressure chamber, so that the interruption performance is improved. When the arc extinguishing chamber in which the contacts are disposed has a smaller inside volume than the inside volume of the other outer pressure chamber, a small arc energy at the initial stage of the contact opening operation can be effectively utilized to obtain a high pressure fluid, so that improved interruption capability is ensured even for a small current. Further, the communicating ports between the two pressure chambers enable the pressure of arc extinguishing fluid within the pressure chamber to be raised before it is released, also ensuring that the circuit interrupter of the present invention has an excellent arc extinction performance with a simple small structure.

What is claimed is:

1. A self-extinguishing gas circuit interrupter, comprising:

a casing for containing in use an arc extinguishing fluid;

means within said casing and comprising a first closure member for defining therein a first pressure chamber;

means within said first closure member and comprising a second closure member for defining therein a second pressure chamber within said first pressure chamber, wherein said first pressure chamber is defined between the exterior of said second closure member and the interior of said first closure member;

said first and said second closure members each having a respective hole therethrough with the respective holes aligned;

a pair of separable electrical contact elements, a first of said contact elements being elongated and extending through the respective holes through said first and second closure members and being dimensioned to close the respective holes through said first and second closure members when said first contact element extends through the pair of aligned holes and into said second closure member, the second of said contact elements disposed within said second closure member and in contact with said first contact element when said first contact element extends sufficiently far into said second closure member, wherein said second closure member is dimensioned to define said second pressure chamber having an interior larger than said first contact element to provide a space therebetween when said first contact element extends into said second pressure chamber and is in contact with said first contact element, and said first contact element being moveable to separate from said second contact element and open the respective holes through said first and second closure members; and fluid control means in said moveable first contact element and cooperative with said first and second closure members for maintaining said pressure chambers substantially closed and retaining arc extinguishing fluid under pressure within said pressure chambers until said moveable first contact element has moved a predetermined distance from said second contact element, and for allowing fluid to flow therethrough from said pressure chambers into said casing after said moveable first contact element moves beyond the predetermined distance from said second contact element.

2. A circuit interrupter as claimed in claim 1, wherein said second closure member defines a second pressure chamber having a smaller volume than said first pressure chamber.

3. A circuit interrupter as claimed in claim 1 or 2, wherein said fluid control means is comprised of a hollow cylindrical portion of said movable first contact element including a nozzle at the tip of the contact element which extends into said second pressure chamber and a vent opening in the circumferential surface of the contact element, said vent opening being located such that it is closed by a portion of said first closure member before the movable contact element travels said predetermined distance and it is exposed to the interior of said casing after the movable contact element has traveled beyond said predetermined distance during the separation of said contact elements.

4. A circuit interrupter as claimed in any one of claims 1 or 2, further comprising means for allowing fluid to flow from said second pressure chamber into said first pressure chamber when the fluid pressure within said second pressure chamber exceeds the fluid pressure within said first pressure chamber by a predetermined pressure difference.

5. A circuit interrupter as claimed in claim 4, wherein said means for allowing fluid to flow is comprised of a check valve disposed between said second and first pressure chambers.

6. A self-extinguishing gas circuit interrupter, comprising:

a casing for containing in use an arc extinguishing fluid;

means within said casing and comprising a first electrically insulating closure member for defining therein a first pressure chamber;

means within said first closure member and comprising a second electrically insulating closure member for defining therein a second pressure chamber within said first pressure chamber, wherein said first pressure chamber is defined between the exterior of said second closure member and the interior of said first closure member;

said first and said second closure members each having a respective hole therethrough with the respective holes aligned;

a pair of separable electrical contact elements, a first of said contact elements being elongated and extending through the respective holes through said first and second closure members and being dimensioned to close the respective holes through said first and second closure members when said first contact element extends through the pair of aligned holes and into said second closure member, the second of said contact elements disposed within said second closure member and in contact with said first contact element when said first contact element extends sufficiently far into said second closure member, and said first contact element being movable to separate from said second contact element and open the respective holes through said first and second closure members; and fluid control means comprised of a hollow cylindrical portion of said movable first contact element and including a nozzle at the tip of the contact element which extends into said second pressure chamber and a vent opening in the circumferential surface of the contact element, said vent opening being located such that it is closed by a portion of said first closure member before the movable contact element travels a predetermined distance, said control means being cooperative with said first and second closure members for maintaining said first and second pressure chambers substantially closed and separated from each other and retaining arc extinguishing fluid under pressure within said pressure chambers until said movable first contact element has moved said predetermined distance from said second contact element, and for allowing fluid to flow therethrough from said pressure chambers into said casing after said movable first contact element moves beyond the predetermined distance from said second contact element.

7. A circuit interrupter as claimed in claim 6, wherein said second pressure chamber has a smaller volume than said first pressure chamber.

8. A circuit interrupter as claimed in claim 6, further comprising means for allowing fluid to flow from said second pressure chamber into said first pressure chamber when the fluid pressure within said second pressure chamber exceeds the fluid pressure within said first pressure chamber by a predetermined pressure difference.

9. A circuit interrupter as claimed in claim 8, wherein said means for allowing fluid to flow is comprised of a check valve disposed between said second and first pressure chambers.

* * * * *